United States Patent [19]

McCulloch

[11] 4,061,804

[45] Dec. 6, 1977

[54] NON-DIRECTIONAL RECTANGULAR FILAMENTS AND PRODUCTS

[75] Inventor: Walter Graham McCulloch, Candler, N.C.

[73] Assignee: Akzona Incorporated, Asheville, N.C.

[21] Appl. No.: 713,954

[22] Filed: Aug. 12, 1976

[51] Int. Cl.[2] ..... B32B 33/00

[52] U.S. Cl. ..... 428/17; 428/85; 428/92; 428/369; 428/397

[58] Field of Search ..... 428/17, 85, 92, 369, 428/397, 401; 272/59 R, 70; 273/29 R, 32 R, 195 R, 55 R, 87 R, 94 R, DIG. 13

[56] References Cited

U.S. PATENT DOCUMENTS

| | | | |
|---|---|---|---|
| 2,812,782 | 11/1957 | Stevens | 428/369 |
| 3,332,828 | 7/1967 | Faria | 428/17 |
| 3,513,061 | 5/1970 | Vinicki | 428/17 |
| 3,513,062 | 5/1970 | Vinicki | 428/17 |
| 3,565,742 | 2/1971 | Stephens | 428/17 |
| 3,573,147 | 3/1971 | Elbert | 428/17 |
| 3,673,056 | 6/1972 | Nadler | 428/17 |
| 3,837,980 | 9/1974 | Nishimura | 428/17 |

*Primary Examiner*—Marion E. McCamish
*Attorney, Agent, or Firm*—Francis W. Young; Jack H. Hall

[57] ABSTRACT

Disclosed herein are novel synthetic polymer filaments, and yarns made therefrom, for use in synthetic turf products. The filaments have a rectangular cross-section and the normal directional tendency of such filaments when used in synthetic turf is overcome by folding or texturing the filaments in such a manner that, while the normal advantageous flexibility of the rectangular filament is retained, the directional tendency is removed. When filaments of the invention are used to produce synthetic turfs, the turf surface imparts an essentially non-directional response to objects rolled thereon.

25 Claims, 5 Drawing Figures

NON-DIRECTIONAL RECTANGULAR FILAMENTS AND PRODUCTS

BACKGROUND OF THE INVENTION

This invention relates to synthetic polymer filaments of rectangular cross-section which have been textured in such a manner as to render them essentially non-directional and suitable for use in synthetic turf products, such as golf greens.

A considerable commercial interest has developed in synthetic or man-made turfs. Fur example, the product disclosed in U.S. Pat. No. 3,328,828 consists of filaments which are tufted into a backing. To resemble natural turf, the filaments must be of heavy denier (e.g., 100 or above). However, with such large filaments, flexibility becomes a problem which is overcome by the use of filaments with a rectangular cross-section (width/thickness >3/1). However, rectangulr filaments have a tendency to bend only along the longitudinal axis and this tendency increases as the size of the filament increases. i.e., the rectangular filaments are said to have a directional character. After tufting, weaving, or knitting to form turf, the flat rectangular, ribbon-like filaments are oriented uniformly with the result that the pile lays preferentially in the direction corresponding with the directional tendency of the filaments. It can be seen intuitively that in stroking an object across the pile surface, such as a golf ball, if the ball is stroked with the pile lay, the surface will roll much faster than if the ball is stroked against the pile lay. A ball stroked at an angle to the pile lay will tend to deviate from its natural course.

To overcome the directional drawbacks of large rectangulr filaments, it has been suggested (e.g., see U.S. Pat. No. 3,565,742) that short lengths of filaments be flocked onto an adhesive-covered backing to achieve a more random orientation of the filaments. This procedure, however, cannot be performed on conventional tufting, knitting, or weaving machinery. Many other techniques have also been tried to minimize the directional tendencies of the synthetic turf surface. See, for example, U.S. Pat. Nos. 3,513,061 and 3,513,062.

Another problem associated with large rectangular filaments, in addition to their tendency to bend only along the longitudinal axis, is the low covering power of such filaments. To overcome this problem in artificial turf, U.S. Pat. No. 3,681,912 suggests texturing the filaments by twisting the filaments and passing the filament edges over a heated surface. Intuitively, it can be seen that this process imparts a relatively small and uniform amount of texturing to the filaments, i.e., it is questionable how much the natural stiffness and directional tendencies of the filaments are reduced. Additionally, such processes are generally not suitable to high speed performance.

DESCRIPTION OF THE INVENTION

The invention overcomes difficulties associated with the prior art by forming synthetic turf from continuous ribbon filaments of at least 100 denier each characterized by major (longitudinal) and minor (lateral) axes. As viewed laterally along the minor axis, the fibers have an essentially rectangular cross-sectional area. To overcome the directional tendency of the rectangular filaments, each filament is textured to provide a plurality of folds wherein both the major and minor axes bend simultaneously to show the major longitudinal plane of the filament at an angle with respect to portions of the plane on the other side of the fold. The folds are randomly oriented with respect to one another (i.e., they appear irregularly in the filament) and it has been found that the presence of such folds overcomes the natural directional flexibility of the rectangular cross-section and imparts a substantially universal, non-directional flexibility to the filaments.

Figure 1A:
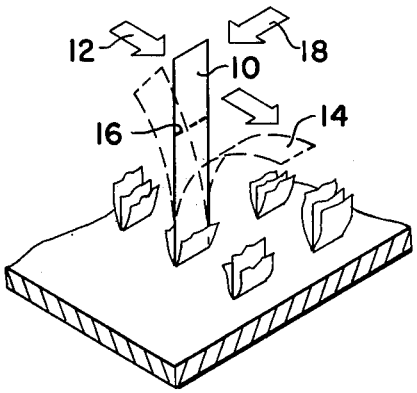
FIG. 1 shows a backing having filaments of the prior art (FIG. 1*a*) and of the present invention (FIG. 1*d*) tufted therein.
FIGS. 1*b* and 1*c* show the individual filaments in more detail.
Figure 1D:
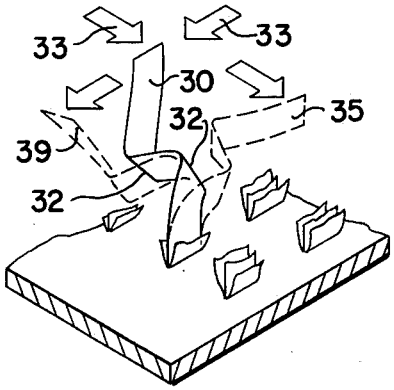
PRIOR ART FIG. 1d
Figure 1B:
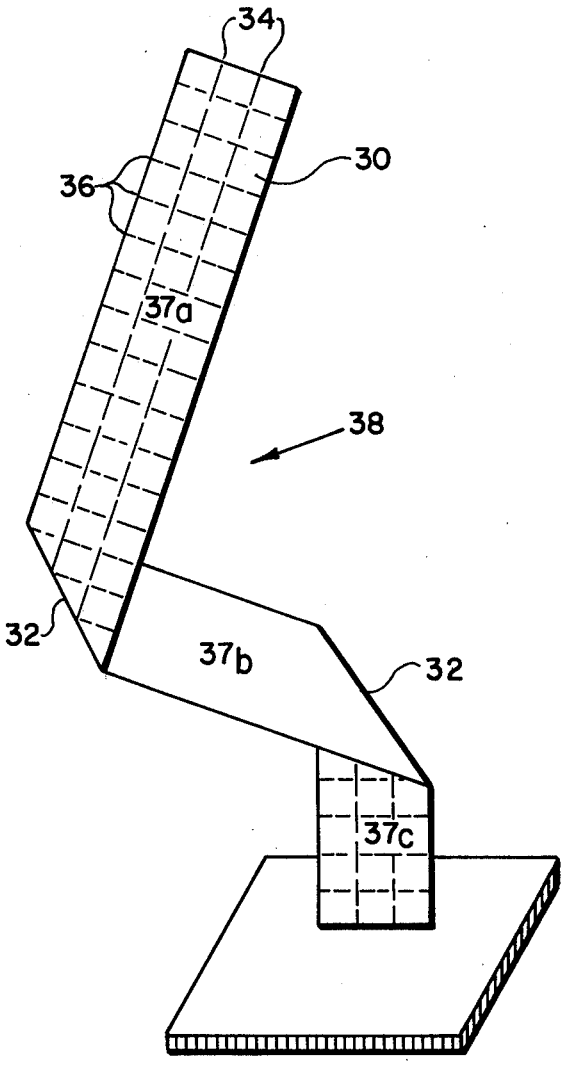
Figure 1C:
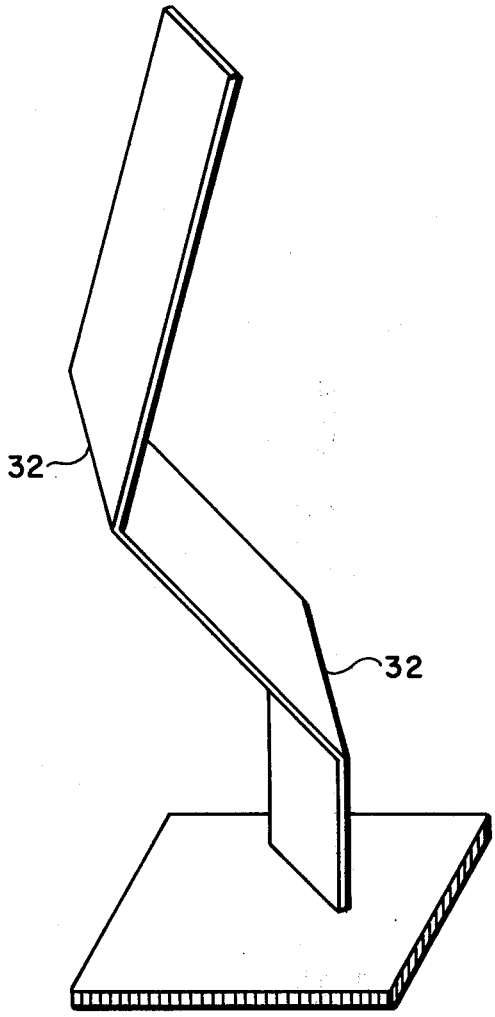

To better illustrate the invention, reference is made to FIG. 1*a* depicting prior art synthetic turf having large (e.g., above 100 denier) rectangular filaments. In filament 10 when a force 12 is applied, the filament tends to bend along the longitiudinal axis 14 rather than along the lateral axis 16. If a force 18 is applied to filament 10, against the lateral axis, bending is resisted, although, of course, the filament will bend if the force is sufficiently large. By contrast, in FIG. 1*b*, depicting the invention, the filament 30 has several folds 32 wherein both the major axis 34, and the minor axis 36 bind simultaneously to skew or twist the major longitudinal plane 37 of a filament at an angle with respec to other portions of the same plane. For example, plane 37*a* forms an angle of approximately 90° with 37*b* and the angle between 37*b* and 37*c* is somewhat greater than 90°. It should also be understood that the portions of plane 37 (37*a*, 37*b*, 37*c*) need not be in the same vertical plane, i.e., the folds impart a three dimensional nature to the filament. This is shown in FIG. 1*c* which is a side view of 1*b* as viewed along arrow 38. It is the simultaneous bending of both the major and minor axes which imparts to filaments of the invention a three dimensional nature and a texture and "feel" resembling natural turf.

In addition, the simultaneous bending of the filament axes gives the filaments an essentially non-directional nature when employed as piling in synthetic turf products. With reference to FIG. 1*d*, the filament 30 has several three-dimensional folds 32 which due to the simultaneous bending of the filament axes, resemble universal joints in the sense that they can be distorted, either singly or in combination to flexibly accommodate a force 33 applied from any direction with the result that the filament is distorted, for example, to assume positions such as shown at 35 and 39. Because of the system of three-dimensional folds, whatever stiffness is present, because of the rectangular cross-sectional of the filament, is turned into an advantage because as the force 33 is applied, it is transmitted along the filament to the joint or fold area 32 where the filament bends to accommodate the force. If the fold cannot fully accommodate the force applied, the residual is transmitted further along the filament to other folds were further distortion can take place. As a result, the filament is relatively uniformly flexible in any direction and, when used in synthetic turf, provides an essentially non-directional response to objects such as golf balls, rolled across the surface of the turf.

Figure 2:
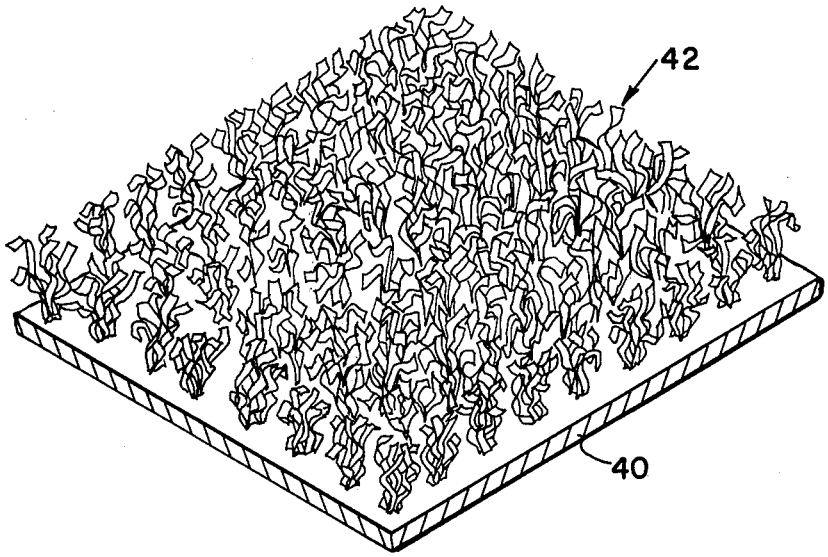
FIG. 2 is synthetic turf of the invention.

In another embodiment of the invention, with reference to FIG. 2, the non-directional filaments are tufted into a backing 40 on conventional machinery with the loops being cut to form a synthetic turf with a cut-pile surface, indicated generally at 42. Because of the folds described above, after cutting the individual filaments of the cut pile "bloom" appreciably and achieve a very random orientation, although, of course, they have been tufted into the backing 40 in the conventional oriented manner. The random orientation of the filaments of the invention is particularly significant in that a large number are oriented generally parallel to the surface of the backing so that the sides and edges of the filaments form part of the cut pile surface with the filament ends being buried in the pile. This last factor is very important because directional tendencies associated with the presence of the filament ends at the surface are thereby reduced. The filament folds, besides resulting in a large number of buried ends, also greatly reduce the stiffness of filament ends present at the surface. Also, the covering power of the folded filaments is quite high with the synthetic turf showing little or no "grinning" through. This permits the filaments to be employed in reduced amounts, e.g., synthetic turf made with from 20 to 30 oz./square yard compared favorably in covering power with conventional synthetic turf formed from untextured rectangular filaments employing from 38 to 42 oz./yard.

Although essentially level, the overall pile surface 42 is relatively rough in comparison with a cut-pile surface formed from untextured ribbons. However, due to the relative absence of ends and the reduced stiffness of the filaments, the pile surface greatly resembles natural turf in appearance and also in its performance characteristics. For example, with regard to an object rolled across the surface of the turf such as a golf ball, the surface does not impart abnormal acceleration or deceleration to the ball and, as said above, is also essentially non-directional.

Figure 3:
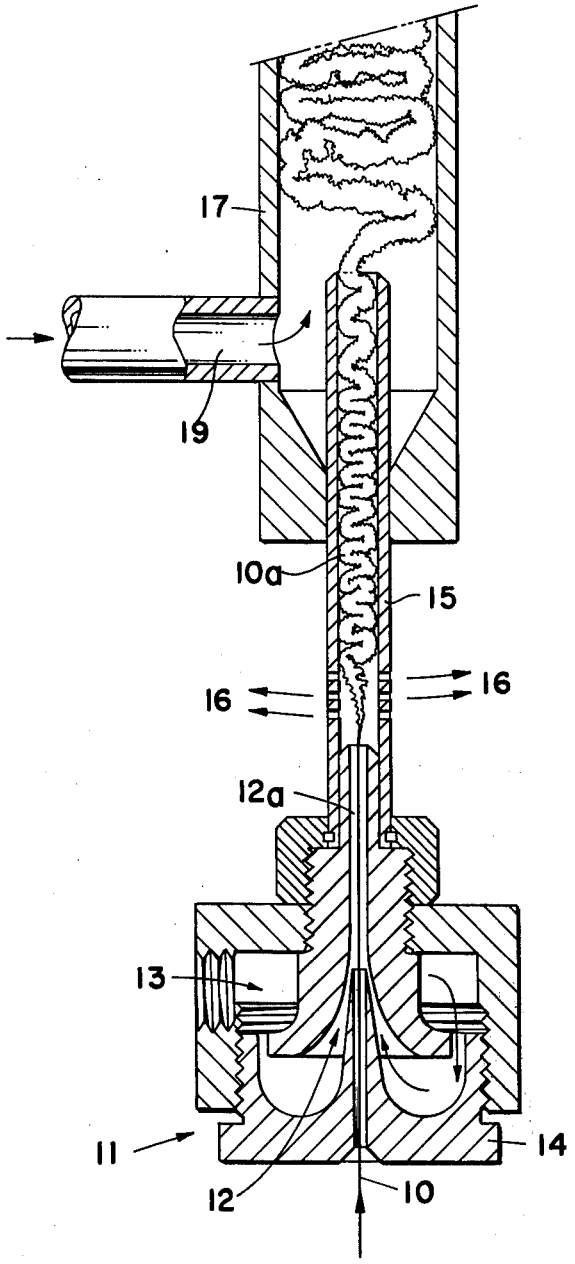
FIG. 3 is a schematic diagram depicting preparation of filaments of the invention.

The novel filaments of the invention are prepared by the process depicted in FIG. 3 and described in more detail in U.S. Pat. No. 3,832,759. With reference to FIG. 3, yarn 10 is drawn into an aspirator indicated generally at 11, by a venturi cup 12. Air for the venturi 12 is supplied through an air inlet 13 in the jet housing 14. The feed yarn is propelled by air through chamber **12*a* into the crimping tube 15 which has an enlarged diameter compared with chamber 12*a*. Also, air used to propel the yarn is allowed to escape through exhaust ports 16 in crimping tube 15. Due to the escape of air and the enlarged diameter of tube 15, the yarn is not propelled through tube 15 with the same velocity as in chamber 12*a* and, therefore, begins to fold back upon itself forming a series of random folds 10*a*. The yarn also impinges upon the walls of tube 15** which also increases the folding action. At this point, the yarn has achieved considerable bulk, but due to the absence of mechanical crimping elements such as are used, for example, in gear crimping, the surface of the yarn is relatively free of abrasion and also retains a generally rectangular configuration. The absence of abrasion is important because in synthetic turf products, the yarn is exposed to large amounts of UV radiation, ozone, oxygen, etc., and surface abrasions provide ideal starting points for deterioration of the yarn.

The folds obtained in tube 15 are set in accumulator tube 17 by the introduction of steam through hollow arm 19. The velocity of the steam also tends to further crimp the yarn filaments but is primarily to set the crimp already developed in tube 15. The yarn passes from tube 17 and is placed under sufficient tension to permit take-up by a conventional winding apparatus (not shown). In the absence of tube 15, the ultimate bulk level imparted to the filaments would be considerably less, i.e., more nearly comparable to normal "stuffer box" processing.

Figure 4:
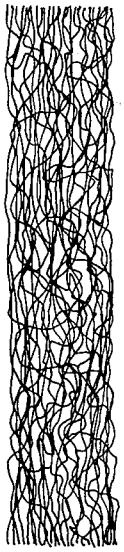
FIG. 4 shows yarn comprised of filaments of the invention.
Figure 5:
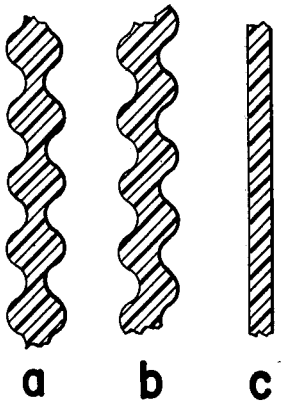
FIG. 5 shows longitudinal cross-sections of various types of rectangular filaments of the invention.

With reference to FIG. 4, it will be seen that after take-up, the individual filaments are physically separate and unbonded, but are also entangled with one another. Each filament has a number of folds distributed randomly along its length. The filaments are also substantially free of ring-like loops. With reference to FIG. 5, the filaments have a generally rectangular or ribbon-like cross-section (FIG. 5*c*). Also, while the sheen normally associated with synthetic filaments is reduced to a great degree by texturing, it may be reduced still further if desired by imparting longitudinal ribs to the filament during extrusion as seen in FIGS. **5*a* and 5*b***.

Of particular interest in fabricating synthetic turf products, it has been discovered that filaments textured as depicted in FIG. 3 contain a large residual shrinkage of 5.0% or more which is developed by application of heat. For example, immediately following texturing, the filaments have a wet bulk level of from 28% to 33% which is measured by the test described below and calculated as follows:

$$\text{Wet Bulk Level (\%)} = \frac{\text{Original length of skein } (\tfrac{1}{2}\text{ circumference})(\text{cm.}) - \text{Final Length of skein } (\tfrac{1}{2}\text{ circum.})(\text{cm.}) \times 100}{\text{Original Length (cm.)}}$$

However, after the filaments have been tufted to form cut-pile synthetic turf, and the turf is heated in an oven set at about 130° C., the pile height as measured from the top of the backing to the cut-pile surface, has been found to shrink by as much as 20 to 25%, and preferably from 35 to 40%. Likewise, this phenomenon is also observed by heating yarn, or individual filaments which have been textured, at a temperature of 138° C. for about 3 minutes. The shrinkage is believed to be due to the relatively large amount of latent, permanent crimp developed in the filaments by the texturing method described in FIG. 3. This high shrinkage and latent permanent crimp is unexpected because in view of the speed with which the filaments are textured, i.e., from 500 to 1000 m/minute, and the very large size of the filaments, it was not anticipated that the heat history of the filaments would be sufficient to impart such a high degree of shrinkage or latent permanent crimp.

The wet bulk level test referred to above was developed to determine the bulk (or crimp) developed in a synthetic carpet yarn that has been crimped by stuffer box or steam. The procedure for measuring the wet bulk is as follows: A glass tube 7 cm. in diameter and 60 cm. in height is filled with distilled water to a point within 0.5 – 1.0 cm. of its top. The water is preheated to 158° F. for nylon or 206° F. for polyester by a 600-watt cylindrical heater controlled by a Variac variable resistor. Using 3 grams pretension, a length of yarn is wound on a skein holder into a skein having a circumference of about one meter. The amount of yarn in the skein is equal to:

$$\frac{14000}{2 \times \text{unbulked yarn denier}}$$

The skein is held by a suitable hook and weighted with a 4.5 gram weight. The skein is measured to the nearest tenth of a centimeter (i.e., ½ the circumference) and then placed in the preheated water bath. At the end of 30 seconds, the skein length is again read to the nearest tenth of a centimeter.

Suitable filaments are those with a denier of at least 100 and may have a denier of 350 or greater, but preferably from 225 to 250, which are extruded from polyamides, polyesters, and polypropylene, e.g., nylon 6, nylon 66, nylon 6, nylon 610, and nylon 11, and their filament forming copolymers. If found advantageous, the filaments may be treated with surfactants, or other means, to roughen the surface sufficient to aid fabrication thereof and prevent footwear slippage. The ribbon should be drawn and treated to provide the physical properties desired depending upon the polymer composition and the utilization planned for the turf. Preferably, the thermoplastic material is pigmented green to simulate the color of grass, although other colors may be used for special effects.

It is known that the addition of certain pigments to thermoplastic materials such as nylon and polyester may increase its resistance to degradation by ultraviolet light, although many pigments, particularly inorganic materials, tend to accelerate such degradation. It has been found that a mixture of about 0.50 percent of a phthalocyanine green and 1.50 percent of a cadmium yellow based on polymer weight provides good color depth and sufficient stabilization against ultraviolet light for most applications.

Phthalocyanine green refers to the well-known chlorinated copper phthalocyanine chelate compounds widely used to colorant; for example, Monastral Green and Mapaco Green pigments made by E. I. du Pont de Nemours, Pigment Department, Wilmington, Del. Cadmium Lithopone yellow designates the common yellow inorganic pigments consisting principally of cadmium sulfide. The cadmium yellow pigments supplied by the Glidden Company, Baltimore, Md., and by Kentucky Color Company, Louisville, Ky., have proven quite satisfactory.

If desired, the nylon may be further stabilized by the incorporation of any of a number of well known UV absorbers which are compatible with the resin. These include such compounds as the aryl esters of phosphoric acid, the alkaryl phosphinates, zinc phosphates, manganous salts, chromium salts, and copper salts. For optimum water resistance properties, the nylon ribbons should be placed under the minimum tension possible.

The backing material may be formed with fibers prepared from polyesters, polyacrylonitrile, polypropylene and nylon. Formation of the backing may be accomplished by weaving and knitting or any of the known processes for preparing nonwovens, particularly needle punching. The backing fibers are preferably green solution dyed to add color depth to the turf and thus enhance the grass-like appearance thereof where this result is desired; however, white or conventionally dyed fibers of green or other colors may be employed.

Synthetic turf products of the invention normally have a face pile height of between ¼ inch and ¾ inch with a face density between 20 and 42 ounces per square yard, and most often about 30 ounces per square yard. The exact pile height desired is, of course, determined by the particular utilization of the turf. For general playground activities such as tennis, volleyball, baseball, softball, touch football, soccer, and badminton, a pile height of about ¼ to ½ inches is preferred. For other applications such as tee-off pads on golf driving ranges and par-3 courses, a turf having a nylon pile height of about ½ to ¾ inches is preferred. A backing composed of fibers woven into a fabric having 18 × 18 (18 warp ends and 18 filling ends) with 3 ounces per square yard is satisfactory for most common applications.

Synthetic turf can be fabricated by weaving, tufting, or knitting. Tufting is the preferred method and is carried out, for example, by tufting 10 to 20 monofilament ribbons on a 5/32 gauge machine at a density of about 30 ounces per square yard into a woven or nonwoven backing fabric. Suitable backing fabrics include 5 to 10 ounces per yarn nylon scrim reinforced needle punched fabric formed from acrylic staple fibers which has been treated with about 1.5 ounces per square yard of an 80/20 mixture of Hycar 1571 and Resloom M-80 resin. Hycar 1571 is a water emulsion of butadiene-acrylonitrile copolymer sold by B.F. Goodrich Chemical Co., Cleveland, Ohio, and Resloom M-80 is a melamine-formaldehyde resin sold by Monsanto Co., St. Louis, Mo.

Another backing material suitable for tufting is a nylon scrim reinforced polyurethane foam carpet backing which is marketed under the trademark, Chemback, by the Chemstrand Co., Division of Monsanto Company. Chemback is comprised of an open-mesh woven nylon scrim coated with foamed polyurethane having a density of approximately 2 lbs. per cubis foot. Chemback is produced in thicknesses of approximately 0.06 to 0.10 inch and in weights of 3 to 6 ounces per square yard.

After weaving, knitting, or tufting the face ribbon with the backing to produce a turf fabric, a solution of latex or the like is applied to the back of the fabric by padding or spraying, although other methods may be used to achieve acceptable results. The latex provides dimensional stability to the fabric and also serves to anchor the ribbons in the backing material. It must, therefore, be of a composition which has good adhesion to both the synthetic ribbons and the synthetic backing material. One such latex composition is a dispersion of Lotol 7562, Pyratex Dow Corning Antifoam, and Alcogum. Other suitable latex formulations are described in Column 4, lines 21 et. seq. of U.S. Pat. No. 3,332,828, and are expressly incorporated by reference into the present disclosure.

As further illustration of the invention, flat monofilament ribbons of nylon 6 were prepared by dry blending nylon 6 chips with phthalocyanine green pigmented chips and extruding this mixture by conventional melt extrusion techniques. The resulting grass green filaments, which were 0.1785 inch wide by 0.0049 inch thick (250 denier), were collected in water, dried, drawn at a ratio of 3.7 to 1 and taken up as a bundle of 18 filaments. The cross-sectional configuration was essentially as depicted in FIG. 5*a*. The filaments were textured according to the method depicted in FIG. 3 at a rate of 600 meters/minute. The air pressure entering at inlet 13 was 80 p.s.i., steam pressure was 9 p.s.i., the diameter of accumulator chamber 17 was 0.75 inch. The wet bulk level of the yarn bundle was 18 to 25% measured as above.

A cut pile synthetic turf was fabricated using a conventional tufting machine with the machine set at 7 stitches per inch. 5/32 gauge. The pile was about ½ inch in height at a weight of 26 ounces/square yard. The backing was woven polypropylene of 18 × 18 construction (as explained heretofore). A latex adhesive was applied to the underside of the backing and the turf product was cured in an oven at about 280° F. for about 3 minutes to dry the latex. Drying also developed latent crimp in the pile causing a shrinkage of 25% to ⅜ inch in height.

The cured turf product substantially resembled that depicted in FIG. 2 with the pile showing very good coverage with little, if any, "grinning" through, even when the turf was folded back upon itself so that the two folded sides were almost flush one with another leaving only a small loop along the fold line.

When viewed by a person standing thereon, the turf product has a very close resemblance to natural turf and in addition the performance characteristics very closely resemble those observed with natural turf. For example, when employed as a synthetic golf green, the turf product did not provide either abnormal acceleration or deceleration to golf balls and did not appear to cause the balls to deviate from the direction in which they were stroked, i.e., the cut pile surface appeared to be essentially non-directional.

What is claimed is:

1. Continuous universally-flexible ribbon filaments of at least 100 denier each for use in outdoor cut-pile synthetic turf, said filaments having a substantially rectangular cross-sectional configuration characterized by major and minor axes which impart a directional flexibility to the filament, each of said filaments having a plurality of folds wherein both the major and minor axes bend simultaneously, said folds being randomly oriented with respect to one another to overcome the natural directional flexibility of the rectangular cross-section and impart universal, non-directional flexibility to the filaments.

2. The filaments of claim 1 further characterized as possessing high residual shrinkage of at least 5.0% developed by application of heat.

3. The filaments of claim 1 having a denier of from 225 to 250.

4. The filaments of claim 1 being stabilized against degradation from sunlight by incorporation of a UV absorbing material.

5. The filaments of claim 1 having color-pigments incorporated therein.

6. Filaments as in claim 1 comprised of nylon.

7. Filaments as in claim 1 comprised of polyethylene terephthalate.

8. A continuous filament yarn comprising a plurality of entangled but physically separate ribbon filaments of at least 100 denier each, said filaments having a substantially rectangular cross-sectional configuration characterized by major and minor axes which impart a directional flexibility to the filament, each of said filaments having a plurality of folds wherein both major and minor axes bend simultaneously, said folds being randomly oriented with respect to one another to overcome the natural directional flexibility of the rectangular cross-section and impart universal, non-directional flexibility to the filament.

9. A yarn as in claim 8 wherein the filaments possess a high residual shrinkage of at least 5.0% developed by application of heat.

10. A yarn as in claim 8 wherein the filaments have a denier of from 225 to 250.

11. A yarn as in claim 8 wherein the filaments are stabilized against UV degradation.

12. A yarn as in claim 8 wherein the filaments are pigmented.

13. A yarn as in claim 8 wherein the filaments are nylon.

14. A yarn as in claim 8 wherein the filaments are polyethylene terephthalate.

15. A cut-pile synthetic turf product wherein the pile is formed of ribbon filaments of at lest 100 denier each, having a substantially rectangular cross-sectional configuration and characterized by major and minor axes which impart a directional flexibility to the filament, each of said filaments having a plurality of folds wherein both the major and minor axes bend simultaneously, said folds being randomly oriented with respect to one another to overcome the natural directional flexibility of the rectangular cross-section and impart non-directional flexibility to the filaments, said turf having an essentially uniform, flat pile surface giving a non-directional response to objects rolled thereon, due to the universal flexibility of the filaments forming said surface.

16. A synthetic turf as in claim 15 wherein the pile filaments have high residual shrinkage of at least 5.0% which can be developed by heating the turf product to reduce the drag imparted by the pile surface to objects rolled thereon.

17. A synthetic turf as in claim 15 wherein the pile is tufted into a backing material and secured thereto by an adhesive applied to the backing on the side opposite the cut-pile face.

18. A synthetic turf as in claim 17 wherein the backing is latex.

19. A synthetic turf as in claim 15 wherein the cut pile filaments have a denier of from 100 to 350.

20. A synthetic turf as in claim 15 wherein the filaments are stabilized against UV degradation.

21. A synthetic turf as in claim 15 wherein the filaments are pigmented.

22. A synthetic turf as in claim 15 wherein the filaments are nylon.

23. A synthetic turf as in claim 15 wherein the filaments are polyethylene terephthalate.

24. A synthetic turf as in claim 15 wherein the pile filaments are woven into a warp and fill backing.

25. A synthetic turf as in claim 15 having a knitted, cut-pile construction.

* * * * *